United States Patent [19]

Beahn et al.

[11] 3,990,693

[45] Nov. 9, 1976

[54] SHEET FOLDER

[75] Inventors: Kenneth G. Beahn; Irving R. Burnstine, both of Miami, Fla.

[73] Assignee: Baring Industries, Inc., Miami, Fla.

[22] Filed: May 16, 1975

[21] Appl. No.: 578,161

[52] U.S. Cl. ..... 270/61 R
[51] Int. Cl.[2] ..... B65H 45/00
[58] Field of Search ..... 223/37–38; 38/102.91, 143, 102.3; 270/61 R, 62, 67, 80, 81, 82, 85

[56] References Cited

UNITED STATES PATENTS

| | | | |
|---|---|---|---|
| 2,914,320 | 11/1959 | Petre | 270/68 R |
| 3,133,732 | 5/1964 | Beamish | 270/61 R |
| 3,538,555 | 11/1970 | Langston | 223/37 X |
| 3,713,643 | 1/1973 | Gerstenberger | 270/61 R |

*Primary Examiner*—Edgar S. Burr
*Assistant Examiner*—A. Heinz
*Attorney, Agent, or Firm*—Clarence A. O'Brien; Harvey B. Jacobson

[57] ABSTRACT

A sheet folder for grippingly engaging one edge portion of a partially folded sheet, subsequently elevating the edge for suspending the partially folded sheet in a generally vertical orientation and then subsequently forming additional folds in the sheet to provide a completely folded sheet positioned on a stacking platform. The apparatus includes a pair of spaced, vertically oriented endless chains having a clamp mechanism thereon for engaging and supporting the folded edge of a sheet to enable the sheet to be elevated in a generally vertical position with the sheet then being draped sequentially over upper, center and lower fold bars after being released from the clamp mechanism on the endless chains. The endless chains are controlled by switch mechanisms including a pair of manually operated switches which, for safety purposes, requires that both hands of the operator be moved to a position away from the operating mechanism when the machine is operated. Limit switches are provided for stopping the chains at appropriate positions in their movement and foot operated switch means is provided for operating the sheet gripping clamp. The fold bars are swung from a vertical inoperative position to a horizontal operative position by fluid pressure operated piston and cylinder assemblies and tubular members with air discharge orifices are associated with the partially folded sheet to facilitate its movement into engagement with the stationary clamp bars associated with the center fold bars and the stationary bars associated with the lower fold bars.

9 Claims, 7 Drawing Figures

18
14
60
10
58
130
56
164
160
14
158
12
12
12
162
52
16
168
146
140
178
182
62
54
176
128
182
188
144
172
140
166
48
150
46
34
30
28
36
44
38
26
24
22
32

196
115 AC
34
206
129
208
128
200
202
204
222
42
M
226
224
214
190
218
127
220
216
192
210
212
126
228

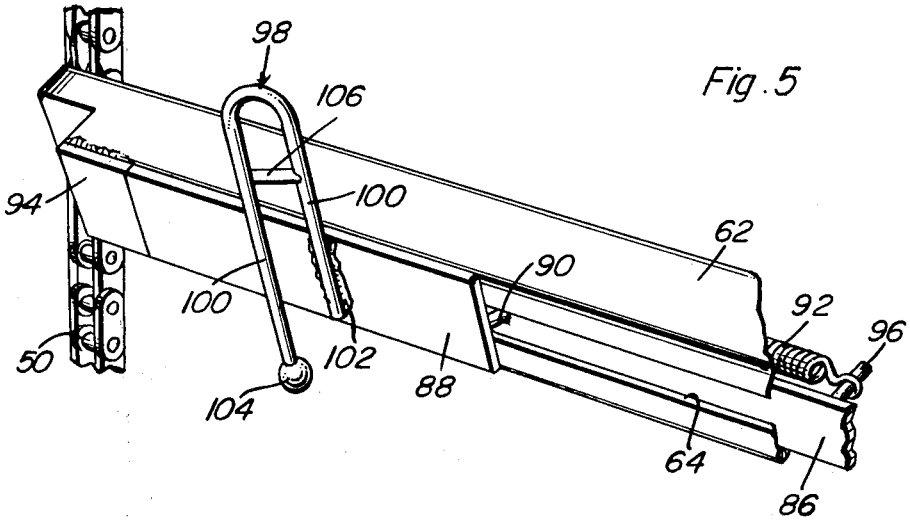
Fig. 5
Fig. 6
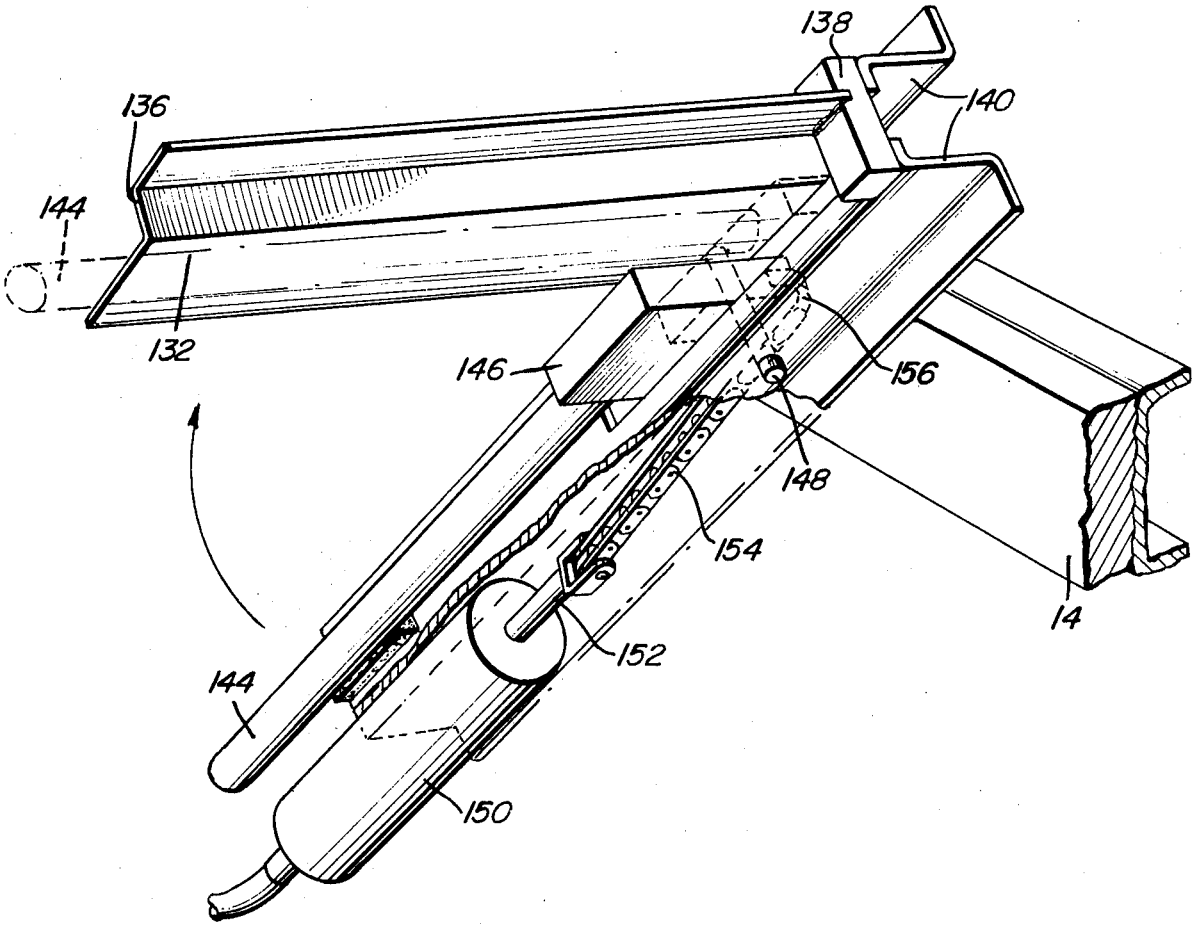

SHEET FOLDER

BACKGROUND OF THE INVENTION

1. Field of the Invention

The present invention generally relates to a folding device for bedsheets and, more particularly, to a semi-automatic machine by which bedsheets can be efficiently folded by a single operator, with the folded sheets being deposited on a stacking platform, thereby enabling the sheet folding operation in a laundry, or the like, to be performed in a more efficient manner and with the expenditure of a minimum time.

2. Description of the Prior Art

The folding of bedsheets and similar linen items in a laundry has been manually performed for many years and normally requires two people, one at each end of the sheet who manipulate the sheet in such a manner to fold it into a desired size. This requires the expenditure of considerable time and materially increases the cost of laundering sheets, and other linen items. Some efforts have been made to mechanize or automate laundry operations by providing relatively complex machines which will fold some laundry items as the final step in a complex laundering operation. Other devices have been provided to form a support for one end of a sheet while the other end is manipulated and folded manually. The following U.S. patents disclose some of the developments in this field:

Nos. 2,025,246 - Dec. 24, 1935; 2,256,327 - Sept. 16, 1941; 3,510,031 - May 5, 1970; 3,713,643 - Jan. 30, 1973.

SUMMARY OF THE INVENTION

An object of the present invention is to provide a sheet folder in which an edge of the sheet is supported in primary folder conditions and the sheet is then elevated and suspended by the primary folder edge while it is straightened and smoothed with the apparatus being then activated to fold the primary folded sheet into cross folds and depositing the folded sheet onto a platform.

Another object of the invention is to provide a sheet folder in which a sheet supporting and elevating device includes endless chains having a clamp bar attached thereto and a clamp mechanism for engaging and supporting a primary folded edge of the sheet with the operating mechanism for elevating and folding the sheet requiring manipulation of two spaced switches so that both hands of the operator must be in contact with the switches when the machine is operated to eliminate any possible injury to the hands of the operator.

A further object of the invention is to provide a sheet folder in accordance with the preceding objects in which upper fold bars and central and lower fold bars are operated by fluid pressure operated piston and cylinder assemblies to properly support, position, grip and fold the sheet.

Still another object of the invention is to provide a sheet folder in accordance with the preceding objects in which the folded sheet is positioned in relation to the central and lower clamp bars by air jets directed against the partially folded sheet to properly orient the sheet during the gripping, folding and releasing of the fold bars and to assist in positioning the sheet on the stacking platform.

Still another important feature of the invention resides in its semi-automatic operation, its elimination of the necessity of having two people available to fold sheets, its effectiveness in quickly and accurately folding sheets and stacking them for access and its capability of folding different standard sized sheets.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a fragmental, perspective view of the sheet engaging device on the clamping bar opposite to the clamping mechanism.

FIG. 6 is a fragmental, perspective view illustrating one of the stationary clamp bars and pivotal fold bars associated therewith and the mechanism for pivoting the fold bar.

DESCRIPTION OF THE PREFERRED EMBODIMENT

Figure 1:
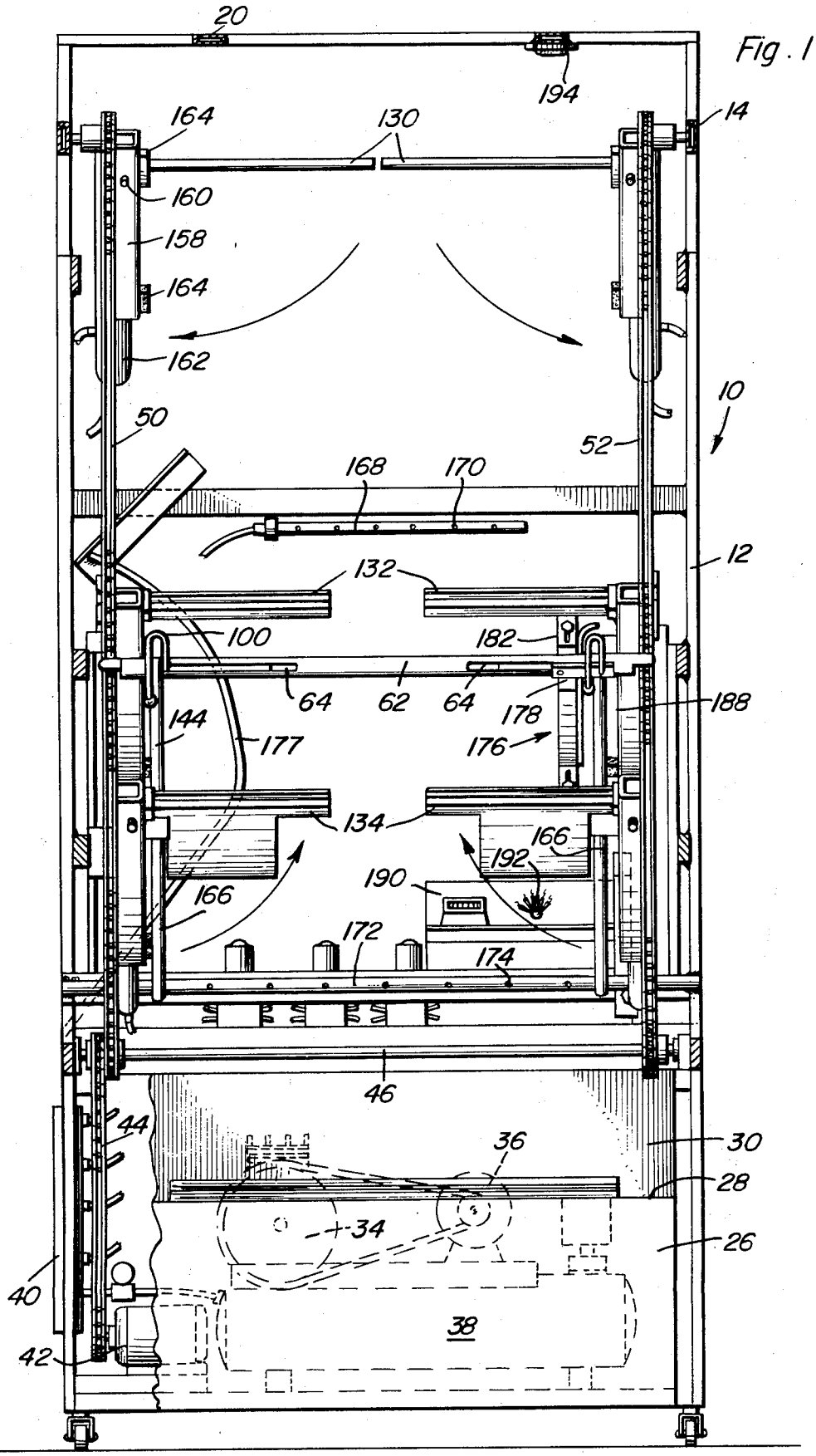
FIG. 1 is a front elevational view of the sheet folder, with portions broken away for clarity, illustrating the relationship of the components.

Referring now specifically to the drawings, the sheet folder of the present invention is generally designated by the numeral 10 and is in the form of a generally vertically elongated rectangular apparatus defined by a vertical frame including vertical corner frame members 12 interconnected by side frame members 14 and rear frame members 16 with the front of the machine being open. The upper ends of the corner frame members 12 are also interconnected by the front and rear frame members 18 and intermediately oriented front to rear frame members 20. The bottom of the frame is also defined by horizontally oriented frame members 22 including a supporting plate 24 mounted thereon adjacent the rear thereof. The forward lower portion of the frame includes a partial front wall 26 secured thereto which extends upwardly to the forward edge of a horizontal platform 28 which has its rear edge connected to a rear vertical wall 30 with the platform 28 defining a stacking platform for folded sheets.

The sheet folder may be supported in any suitable manner and, if desired, supporting wheels, casters, or the like 32 may be provided to enable the device to be moved to a desired location. Also, the supporting plate 24 provides a base for an air compressor 34 powered by an electric motor 36 positioned on top of a reservoir or tank 38 for supplying pressurized air to a maniflod 40. Suitable pressure regulating controls may be provided for the air compressor so that an adequate volume of air at a desired pressure level will be maintained. Also, the plate 24 provides a support for an electric motor 42 which is in driving engagement with a sprocket chain 44 which is entrained about a sprocket gear on a lower shaft 46 which is journaled from the frame and provided with a sprocket gear 48 adjacent each end thereof with one of the sprocket gears 48 being disposed adjacent the drive sprocket gear which is engaged by the chain 44, thus driving the shaft 46 from the motor 42.

Figure 2:
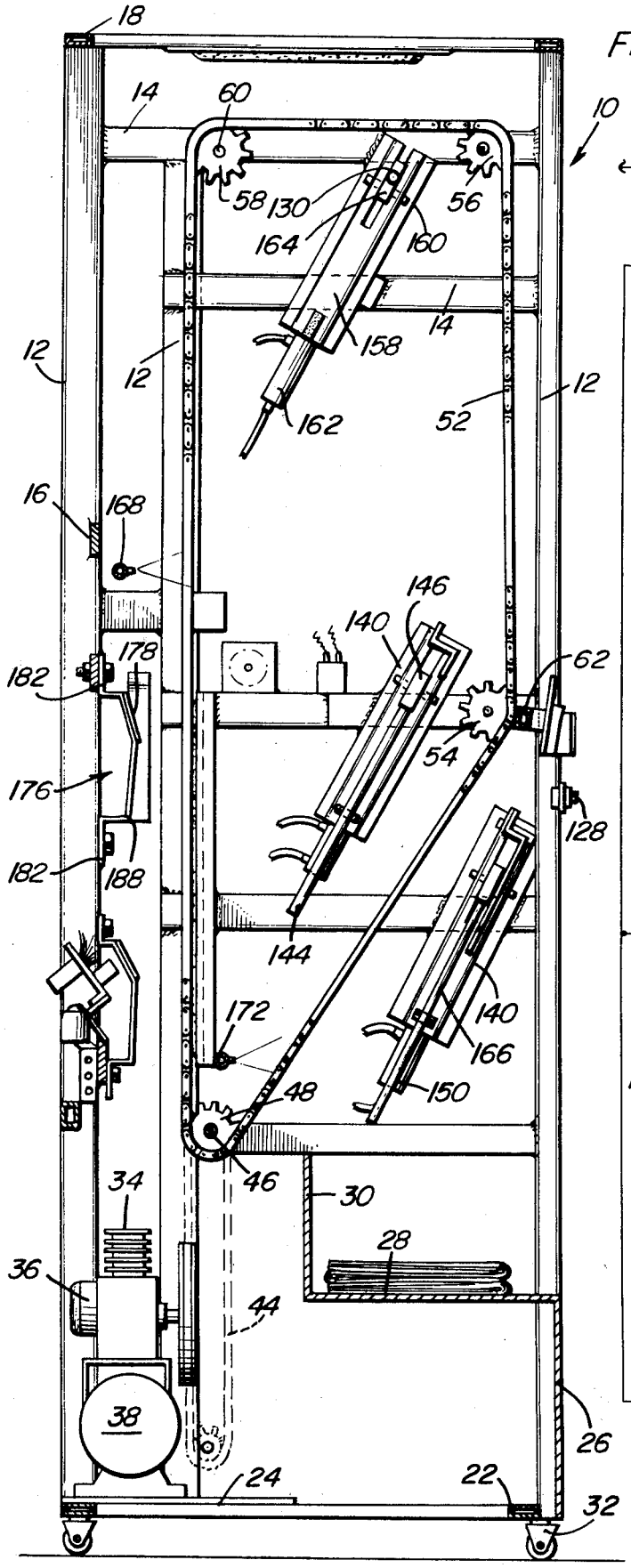
FIG. 2 is a side elevational view of the machine, with portions broken away.

Entrained over the two sprocket gears 48 on the shaft 46 is a pair of sprocket chains 50 and 52 which are vertically oriented and spaced from each other with each of the chains being endless and the sprocket gears 48 being disposed at the lower bottom portion of the path of movement of the chains. As illustrated in FIG. 2, the chains 50 and 52 extend forwardly and upwardly from the sprocket gears 48 and engage the forward periphery of a pair of sprocket gears 54 and then the chains 50 and 52 extend straight upwardly in a vertical direction adjacent the forward edge of the sheet folder and are entrained over a pair of upper front sprocket gears 56. The chains 50 and 52 then extend horizontally rearwardly and are entrained over a pair of upper rear sprocket gears 58 which are in alignment with the lower rear sprocket gears 48. Thus, each of the chains 50 and 52 are entrained over four sprocket gears with the two lower, rear sprocket gears 48 being driven by virtue of being connected with the shaft 46 and the other sprocket gears 54, 56 and 58 being rotatably supported on stub shafts 60 rigid with side frame members 14. As illustrated, some of the side frame members 14 terminate at a vertical frame member 12 which is spaced slightly forwardly from the rear corner frame member 12, as illustrated in FIG. 2, with it being pointed out that the specific frame structure may be varied or altered as long as there is a rigid framework for rotatably supporting the sprocket gears and the shaft 46.

Figure 4:
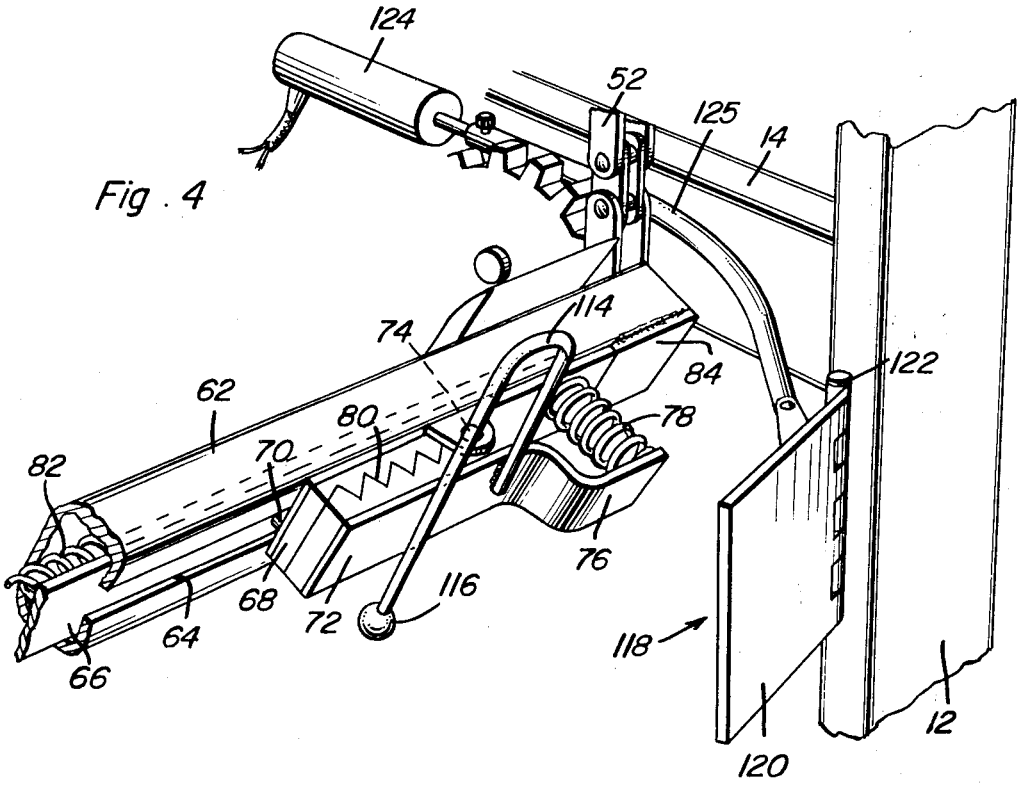
FIG. 4 is a fragmental, perspective view of the sheet corner clamping mechanism on the clamp bar and the device for actuating the same.

Fixedly attached to one of the links in each of the chains 50 and 52 is an elongated hollow clamp bar 62 having a pair of longitudinal slots 64 in the outer surface thereof adjacent each of the chains. A clamp mounting plate 66 is slidably disposed within the tubular bar 62 in underlying relation to the slot 64 adjacent the chain 52 with the mounting plate 66 supporting a stationary clamping member 68 thereon by projecting pins or pegs 70 which extend through the slot 64. A movable clamp member 72 is pivotally attached to the stationary clamp member 68 by a pivot pin assembly 74. The movable clamp member 72 is provided with an offset end portion 76 which is spring biased outwardly by a compression coil spring 78 so that the pivotal clamping member 72 will be spring biased toward the stationary clamping member 68. The clamp member 68 and 72 have serrated jaws 80 in registry and in engagement with each other for securely gripping the corner edges of a sheet in a manner described hereinafter. The mounting plate 66 is longitudinal slidable in the bar 62 and is spring biased toward the chain 52 by a tension coil spring 82 which extends between a pin in the tubular bar 62 and a pin on the mounting plate 66 so that the stationary clamping member 68 will be normally biased into engagement with a limit stop 84 on the bar 62, as illustrated in FIG. 4.

As illustrated in FIG. 5, the other end of tubular bar 62 has a mounting plate 86 slidable therein which is similar to the mounting plate 66 and is slidable in the same manner. The mounting plate 86 includes a support plate 88 mounted thereon and oriented against the outer surface of the bar 62 and is supported from the mounting plate 86 by pins or pegs 90 extending through the slot 64. A coil spring 92 interconnects the mounting plate 86 and the bar 62 for biasing the mounting plate 86 and the support plate 88 outwardly toward the chain 50 with the support plate 88 being limited in its movement by a stop member 94. The spring 92 may be in a form of a tension spring interconnected between a peg 96 on the mounting plate 86 and a similar peg on the bar 62. The support plate 88 includes a supporting structure generally designated by numeral 98 for engaging the interior of a reversely folded portion of the edge of a sheet and which includes a generally U-shaped rod member 100 having a leg thereof rigidly welded to the plate 88 as at 102. The lower end of the outer leg of the U-shaped rod member 100 includes a ball 104 thereon to facilitate positioning of the sheet thereon and to retain the sheet thereon. A transverse member 106 extends across the rod 100 and is provided to limit the movement of the sheet inwardly into the support structure 98, with this member also rigidifying the rod 100.

The clamp assembly on the bar 62 adjacent the chain 52 is also provided with a U-shaped rod-type support 114 having a free ball-shaped end disposed outwardly from the movable clamp member 72 as indicated by numeral 116. In assembling a sheet onto the clamp bar, two ends of a selvage edge or seam edge of a sheet are positioned into overlying alignment with each other and positioned between the clamp members 68 and 72 and securely gripped thereby. This edge of the sheet is then tensioned toward the chain 50 and an intermediate portion of the edge is slipped under and upwardly over the ball-shaped lower end portion 104 of the support 98. The central portion of this edge of the sheet is then moved back to the end of the bar 62 adjacent the chain 52 and positioned upwardly over the ball-shaped lower end 116. Tension is maintained on the sheet during assembly onto the clamping bar so that the clamps or supporting structure are moved inwardly against the bias of the springs whereby the bias of the springs will retain the edge of the sheet mounted on the clamp bar with the edge of the sheet being primary folded, that is, with four layers with each layer being of equal width and the springs 82 and 92 stretch the end edge of the sheet into a smooth and taut condition.

In order to facilitate manipulation of the movable clamp member 72, an actuating mechanism therefor is generally designated by numeral 118 and includes a plate 120 pivoted to a vertical frame member 12 by a hinge structure 122. A piston and cylinder assembly 124 is connected to the plate 120 by an elongated curved rod 125 and anchored to the frame in a suitable manner so that upon contraction of the piston and cylinder assembly 124, the plate 120 will move inwardly, engage the offset end 76 of the movable clamp member 72 and pivot the movable clamp member or jaw 72 away from the stationary clamp member or jaw 68, thus opening the clamp to facilitate insertion of the two aligned corner edges of the sheet. As soon as the aligned corner edges of the sheet have been properly inserted between the clamp members 68 and 72, the piston and cylinder assembly 124 is extended so that the spring 78 will cause gripping of the aligned corner edges of the sheet. Operation of the piston and cylinder assembly 124 is effected by a foot operated control switch 126 which, when operated will cause the piston and cylinder assembly 124 to be contracted and when the foot of the operator is removed from the foot pedal switch, the piston and cylinder 124 will be extended with the piston and cylinder assembly being pneumatically operated by air from the air reservoir 38 through a suitable control valve.

With one end edge of the sheet supported from the clamp bar 62 which is stopped in a position at a convenient heighth for access by an operator, as illustrated in FIGS. 1 and 2, the apparatus is ready for its initial movement which is upward movement of the clamp bar 62 and the end edge of the sheet which is accomplished by the operator manually depressing two control switches 128 with one switch located adjacent each front side of the frame so that the operator must necessarily use both hands and both switches must be depressed at the same time to energize the motor 42 for elevating the clamp bar 62 by movinng the chains 50 and 52, so that the clamp bar 62 and the end edge of the sheet will be moved upwardly over the upper sprockets 56 and upper rear sprockets 58 at which point the clamp bar 62 will be stopped due to limit switches. The operator then smooths the sheet and aligns the edges and folded loop portions of the primary folded sheet so that, in effect, the sheet is suspended from one edge in a generally vertical position with the sheet being primary folded throughout its length.

As the clamp bar 62 and the end edge of the sheet move over the rear sprockets 58, limit switches are engaged which stop the motor 42, which are designated by numeral 129, thus stopping the sheet while it is being smoothed. At this position, the upper end portion of the sheet is supported by a pair of upper fold arms 130 which are located slightly rearwardly of the forward sprocket gears 56 and slightly below the forward sprocket gears 56. As the sheet is being smoothed and the folds properly aligned, the edges of the folded sheet are inserted under a pair of rigidly mounted centrally located clamp bars 132 and a pair of lower rigid clamp bars 134. FIG. 6 illustrates a typical rigid bar 132 which is generally Z-shaped and provided with a downwardly facing inclined gripping shoulder 136 which may be coated with an anti-slip material. The lower bars 134 have a downwardly extending guard plate which will prevent the positioning of the hands under the bar 134. The ends of the rigid bar 132 or 134 are supported on a block 138 with a pair of parallel mounting angles 400 which are rigidly affixed to the side frame 14. In this condition, the sheet has been completely smoothed and primary folded and is supported in overlying relation to the upper fold arms or bars 130 and in underlying relation to the rigid bars 132 and 134.

Associated with each of the bars 132 is a swingable clamping and folding arm or bar 144 which is rigid with a mounting block 146 at one end thereof pivotally received between the mounting flanges or angles 140 and pivoted thereto adjacent one corner by a pivot pin 148 which extends through the mounting angles and the block 146 so that the arm 144 may swing about an axis so that it can assume a position below and in clamping relation to the bar 132, as illustrated in broken lines in FIG. 6, for clamping the sheet in place.

For actuating the arm 144, a pneumatic piston and cylinder assembly 150 is mounted between the angles 140 and includes a piston rod 152 which is longitudinally reciprocal therein and the piston rod 152 is connected to a flexible link chain 154 that is attached to the corner of the block 146 as at 156. The attachment of the chain 154 to the block 146 is spaced from the pivot axis 148 in a manner that retraction of the piston rod 152 will swing the block 146 and the arm 144 approximately 90° and bring the arm 144 into underlying clamping engagement with the sheet positioned under the bar 132 with the friction material serving to securely grip the sheet. Both clamp arms 144 associated with the two stationary bars 132 will be actuated simultaneously for gripping the sheet. As soon as the arms 144 are in gripping position, the upper folding arms 130 are swung downwardly and since the end edge of the sheet has been released from the clamp bar 62, the upper edge of the sheet is then free to fall the primary and cross quarter folded sheet then is draped over the central folding arms 144 with the primary and cross folded sheet being supported with the two lower portions being substantially in alignment.

The upper folding arms 130 are supported from channel-shaped support members 158 similar to the angles 140 for pivotal movement about a pivot pin 160 with a piston and cylinder assembly 162 being connected to the mounting block 164 for the arms 130 in the same manner as illustrated in FIG. 6, so that when the piston and cylinder assembly 162 is extended, the arms 130 will swing downwardly in an arc to a position alongside of the channel-shaped member 158. A cushioning pad 164 is provided on the channel-shaped member 158 and also on the angle members 140 to cushion the downward movement of the folding arms 130, 144 or 166 when they are swung to their retracted positions.

As soon as the draped sheet reaches its position supported from the central fold arms 144, the lower fold arms 166 are swung upwardly into gripping engagement with the sheet which is gripped between the lower arms 166 and the lower stationary arms or bars 134 at a point centrally of the draped sheet. As soon as the lower arms 166 are in clamping position in relation to the sheet, the central fold arms or bars 144 are retracted back to their position alongside of the angles 140 thus draping the sheet over the lower bars 166 and thus supporting the sheet in a cross folded condition lengthwise. As soon as the sheet is draped from the lower bars 166, the lower bars 166 are retracted to their position alongside of the angles 140 and thus the folded sheet drops onto the platform 28. Thus, by folding the sheet into four layers lengthwise to form a primary folded sheet and then forming a central cross fold and two additional cross folds in the lengthwise folded sheet, the sheet is ultimately folded into a condition having 32 layers.

An air tube 168 is oriented transversely of the frame adjacent the rear thereof and substantially below the upper rear sprockets 58 as illustrated in FIGS. 1 and 2 with the tube 168 including a plurality of nozzles or orifices 170 which are directed forwardly and which will direct air against the sheet for holding it against the stationary arms 132 and 134. A lower air tube 172 is disposed forwardly of the chains adjacent the lower sprocket gears 48, as illustrated in FIGS. 1 and 2, with this manifold also including orifices or nozzles 174 for directing air forwardly to move the lower end of the folded sheet toward the front of the machine to facilitate the folding operation.

The cam structure for releasing the sheet clamp is generally designated by numeral 176 and includes an inclined plate 178 having a wear surface of stainless steel, or the like, thereon. The plate 178 is vertically adjustably supported by slotted brackets 182 at each end. The plate 178 and its wear surface is positioned in the path of movement of the offset portion 76 of the sheet clamp so that when the sheet clamp passes the cam structure 176, the clamp will be released by the cam surface pushing the offset end 76 of the movable clamp member 72 inwardly against the spring 78. The upper end of the wear surface on the plate 178 is inclined and curved in a manner to guidingly engage the offset member 76. Also, an edge cam plate 186 having an outwardly flared upper end is disposed along the edge of the plate 178 to move the entire clamp assembly longitudinally inwardly of the clamp bar to release the tension on the sheet at the same time the corner edges are released so that the primary folded end edge of the sheet will be released from the clamp bar in a straight and smooth condition.

Figure 3:
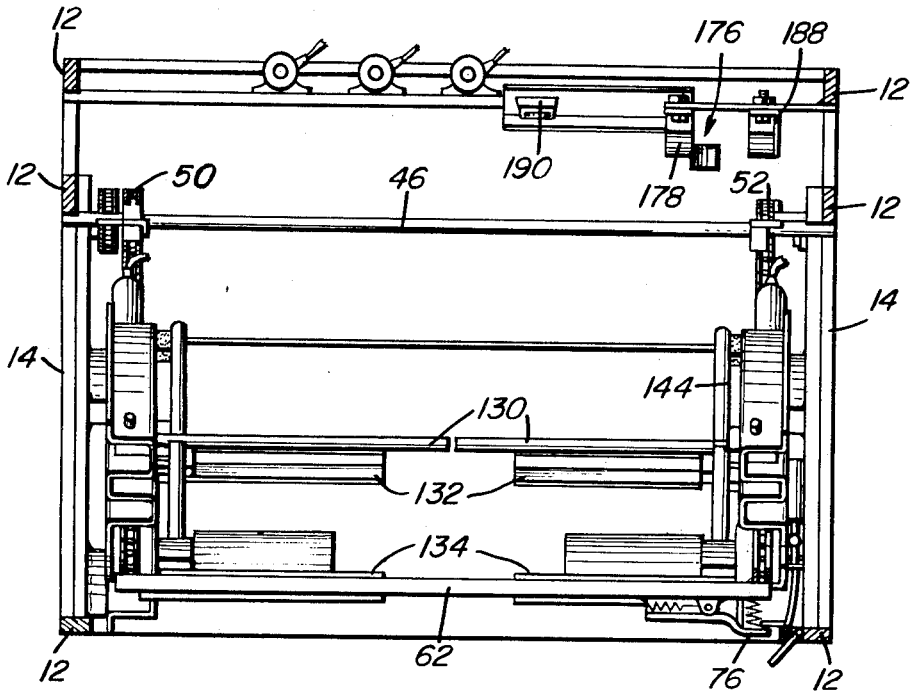
FIG. 3 is a top plan view of the machine, with portions broken away.

Disposed below and outwardly of the release cam mechanism 176 is a similar release cam mechanism 188 for use when the device is employed to fold wider sheets, such as, king size sheets, and the like. The resiliency of the springs enables the clamps and pins to effectively support a king-size sheet with the release mechanism 188 being positioned below and outwardly so that this clamp mechanism will be released after the king-size sheet has been elevated a slightly greater distance. The vertical orientation of the king-size release cam mechanism 188 is illustrated in FIG. 2 and the lateral orientation thereof is illustrated in FIG. 1 and FIG. 3.

Also supported at the rear of the frame is a counter mechanism 190 and an indicator light 192, an optional feature, which will count and indicate the number of sheets which have been folded and the indicator light will indicate that a predetermined number of sheets have been folded and deposited on the stacking platform.

The top of the frame is provided with a guide structure 194 extending from front to rear which centralizes the sheet as it goes over the portion of the frame between the upper sprockets 56 and 58. Since the clamps and pins or fingers mounted on the clamp bar 62 float resiliently, the horizontal edge of the guide 194 will assure that the clamp structure at the right end of the clamp bar will be properly oriented as the clamp bar passes over the rear sprockets 58.

With the machine in position with the clamp bar 62 stopped at a position accessible to the operator which stopping point is determined by a limit switch and with the main power switch 196 closed, the compressor will maintain air in the reservoir tank at a predetermined pressure in a well known manner. Such components are conventional in and of themselves and form no particular part of the invention except for their association in performing in the manner intended. The operator locates the opposing corners of any size sheet along the selvage or seam edge and brings these corners together. He then steps on the foot switch 126 which, by actuating the piston and cylinder assembly 124 will cause the plate 120 to pivot inwardly and open the movable jaws 72 with the foot operated switch energizing a holding coil or relay to maintain the clamp in open position for a predetermined length of time sufficient to enable the operator to properly position the aligned, overlying corners of the sheet into the clamp with release of the foot switch enabling the clamp to close. By inserting his hand between the two edges of the operator can now locate the half-way point of the sheet and by holding that loop with one hand, the operator can form a loop at some point between the hand and the holding clamp. This loop is then positioned around the supporting structure 98 and particularly, the rounded end 104 thereof and moved upwardly so that this loop is positioned around the supporting pin at the opposite end of the clamp bar from the holding clamp. The central loop that was initially formed is then pulled toward the holding clamp and positioned on the pin 116. Since both the holding clamp and the pin at each end of the clamp bar or starter bar are spring loaded away from each other, tension is applied equally holding the primary folded edges of the sheet in position. The machine is then ready to commence its operation which is started by the operator simultaneously pressing both of the start buttons 128 located at opposite sides of the machine so that the motor 42 will elevate the clamp bar 62 and the sheet to a point at the upper rear sprocket where it stops automatically by contacting a limit switch. The sheet is now primary folded and semi-draped over the upper fold arms 130. The operator now locates the same two edges of the sheet that are in the clamp at a point close to the trailing edge and holds these edges together in one hand and by sliding the other hand crossways of the sheet, the half fold of the trailing edge of the sheet is located and this edge is in turn brought over to the right hand side of the machine and held with the right hand. The left hand then grasps the left folded edge and by slightly snapping the entire sheet, it is smoothed and positioned. The operator also places the front hanging portion of the sheet behind the stationary clamping bars 132 and 134 so that the primary folded condition of the sheet will be maintained.

The operator must then again push both start buttons 128 which assures that both hands are out of the unit and the leading edge of the sheet starts its downward travel at the rear of the unit as the clamp bar 62 moves downwardly from the rear sprockets 58. Upon reaching a predetermined lower point, the holding clamp is released by its contact with the cam structure 176 and the lateral cam 186 which moves the right hand clamp structure slightly inwardly. Also, a cam rod 177 on the left side of the machine will dampen or limit outward movement of the left hand pin when the right hand clamp releases the sheet thereby preventing the left hand pin 100 from flipping the end of the sheet to the left when released. Release of the sheet allows the sheet to stop and the clamp bar will continue downwardly a few inches before it stops. At this point, the sheet is draped over the upper fold bars 130 and a central cross fold is formed at the 54'' point on a sheet which is 108 inches long. A blast of compressed air from the tube 168 forces the sheet forward and the center fold bars 144 now come up and forward and clamp the sheet against the center stationary clamping bars 132 at the 27'' point of the sheet. Immediately, the upper fold bars 130 release in a downward and rearward angle which drapes the sheet over the center fold bars 144. An air blast then is emitted from the tubes 168 and 172 to force the draped sheet against the lower stationary clamp bars 134 and the lower fold bars 166 now come up and forward to clamp the sheet, at the 13½ point, against the lower stationary clamping bars 134 and immediately, the center fold bars 144 are released and fold downwardly and rearwardly which then drapes the sheet over the lower fold bars 166 with the clamping action being angular thus moving the lower free edge of the folded sheet in an arc so that when the lower fold bars 166 are released, the sheet will be deposited flatwise on the stacking platform. The counter structure will count the number of sheets on the stack platform by sensing movement of the clamp bar and provide an indicating signal to the operator so that the operator will realize that a predetermined number of sheets are on the stacking platform so that they may be removed.

The pneumatic system includes double acting piston and cylinder assemblies for the clamp actuator, the upper arms, the central arms and lower arms for positive movement in both directions with each of the pneumatic piston and cylinder assemblies being controlled by a solenoid operated valve with the valve for the upper and lower arms being a four-way valve as is the valve for the clamp actuator with the lower arms being controlled by a four-way valve. Also, a two-way valve controls air flow to the upper and lower air blast tubes or manifolds.

Figure 7:
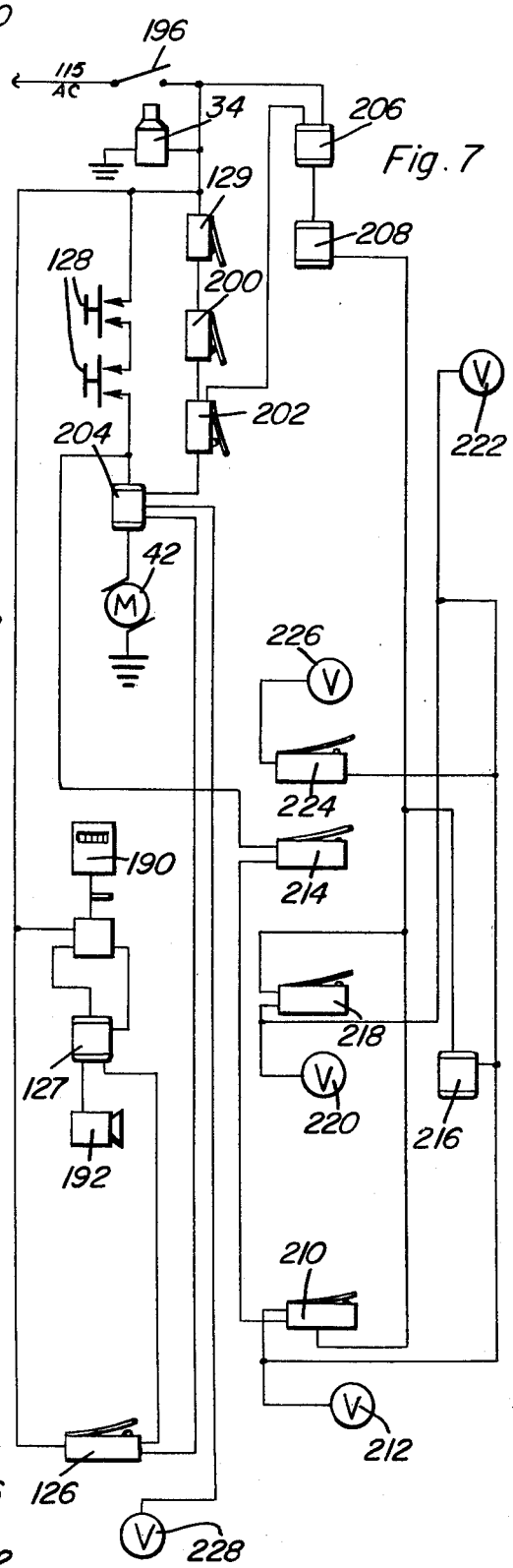
FIG. 7 is a schematic view illustrating diagrammatically the control system for the sheet folder.

The electrical circuit involved is arranged to operate the machine in a semi-automatic manner with operation of the foot switch 126 energizing the counter and indicator through a time delay relay 127 in a well known manner and the valve controlling the piston and cylinder assembly 124 which operates the clamp to open the sheet corner clamps. Depression of the two buttons or switches 128 then operates the motor to elevate bar 62 until chain operated limit switches stop the chain at an initial position with the bar 62 adjacent the upper rear sprockets during which the sheet is smoothed and completely primary folded throughout its length after which the start switches are again actuated to move the chains so that the bar passes the sheet release position and engages a limit switch to stop the chains with the chains temporarily stopping and then moving to a position to engage a third limit switch to stop the bar in its initial starting position. The folding arms 130, 144 and 166 also engage limit switches to sequentially operate these arms in the manner described so that as soon as the sheet edge is released and the bar 62 engages a limit switch just past this position, the center arms will be moved to clamping position and the upper arms moved to a retracted position and energizing the air blast with the lower arms then being moved to a clamping position and the center arms released and the lower arms then being released and actuating the counter which will actuate the indicator when a predetermined number of sheets have been released by the lower arms. In FIG. 7, the first chain limit switch is designated by numeral 129, the second chain limit switch is designated by numeral 200 and the third chain limit switch is designated by numeral 202, all of which are connected to the motor 42 through a motor relay 204. The chain sequence limit switch 202 is also connected to a relay 206 and a time delay relay for the middle arms 208 connected with a limit switch 210 for the lower arms. The limit switch 210 operates valve 212 for the middle arms which is a four-way valve and connects with a limit switch 214 for the upper arms which is connected back to the holding coil for the motor. The limit switch 210 is also connected with the time delay relay 216 and a limit switch 218 for the middle arms which controls the four-way valve 220 for the upper arms and the air blast manifold 222. The relay 216 also is connected to the limit switch 224 for the upper arms connected with the valve 226 for the lower arms. The limit switch 214 for the upper arms extends to the relay 204 which also operates the valve 228 for the camp when energized by the foot pedal switch 126.

The specific normal open and normal closed designations of the various switches are not incorporated herein inasmuch as the electrical circuit may be varied depending upon the components used with any suitable appropriate controls being used for rendering the device operative in the sequence described. Various types of mounting brackets, frame elements and other structural details may be employed utilizing the operational procedures described.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A sheet folder comprising a vertically disposed supporting frame, conveying means supported by said frame for moving the sheet along a fold path, sheet holding means on said conveying means and movable therewith, said conveying means including a pair of laterally spaced, parallel, endless sprocket chains entrained over sprocket gears with a portion of each chain being vertically oriented for moving said sheet holding means vertically, said sheet holding means including means releasably securing an edge of a sheet in primary folded condition for elevating said sheet and suspending it from the primary folded edge when said conveying means is driven to elevate the sheet holding means, a pair of upper folding arms mounted on the frame, a pair of center folding arms mounted on the frame and a pair of lower folding arms mounted on the frame, means for pivoting each of said arms from an inactive position alongside of the path of movement of the sheet holding means to a substantially horizontal active position for sequentially pivoting the pairs of fold arms for supporting the primary folded sheet along longitudinally spaced fold lines, means on said frame for releasing said sheet holding means when the primary folded sheet is draped centrally over the upper folding arms to form a first cross fold, and stationary members associated with the center arms and lower arms for gripping the primary folded sheet when the center arms and lower arms are pivoted to active position, said means pivoting said arms moving the center arms to active position prior to moving the upper arms to inactive position for draping the cross folded sheet into a second cross fold over the center arms, said means pivoting said arms moving the lower arms to active position for gripping the cross folded sheet draped over the center arms against the lower stationary members prior to moving the center arms to inactive position for draping the cross folded sheet centrally into a third cross fold over the lower arms when the center arms are released, said means pivoting said arms releasing the lower arms for gravitational release of the sheet, and a stacking platform receiving the folded sheet.

2. The structure as defined in claim 1 together with air blast means directed against the sheet to maintain it against the stationary center members and stationary lower members during the gripping engagement of the center arms and lower arms.

3. The structure as defined in claim 2 wherein said sheet holding means includes an elongated bar, a pivotal clamp member mounted at one end of the bar for engaging the corner edges of a sheet, a pin mounted adjacent the other end of the bar for receiving a double folded loop portion of the sheet and pin on the clamp to receive the center loop of the folded sheet thus forming a primary folded sheet, said clamp and pin remote therefrom being spring biased outwardly for tensioning the primary folded end of the sheet.

4. The structure as defined in claim 3 wherein said conveying chains define an endless loop path having a pair of vertical portions and a pair of horizontal portions so that the primary folded edge of the sheet will be elevated, moved rearwardly and then moved downwardly with the sheet being released from the holding means when the primary folded edge thereof is moved to a predetermined point downwardly at the rear of the frame.

5. The structure as defined in claim 4 wherein said means for releasing the sheet from the sheet holding means includes cam means releasing the pivotal clamp and cam means moving the clamp toward the remote pin for releasing the sheet from the sheet holding means.

6. The structure as defined in claim 5 together with means opening the pivotal clamp member to enable insertion of the corners of the sheet, said means including foot actuated means for opening the clamp member to facilitate insertion of the aligned corners of the sheet.

7. The structure as defined in claim 6 together with cam means engaging the remote pin to prevent it from moving outwardly when the clamp member is released thereby preventing the released end of the sheet from being flipped outwardly.

8. The structure as defined in claim 7 wherein said means for pivoting the arms includes a piston and cylinder assembly for each arm, each piston and cylinder assembly being mounted on the frame and including an arm supporting block connected to a piston rod by a flexible chain member for swinging the arm from a retracted position alongside the frame to an extended horizontal position, said stationary members being in the form of bars horizontally disposed and spaced from each other to enable the sheet to be positioned under the horizontal bars for gripping engagement of the primary folded sheet by the central arms and lower arms.

9. The structure as defined in claim 8 wherein said piston and cylinder assemblies are pneumatically actuated, a compressor supplying air to the piston and cylinder assemblies and to the air blast means, said air blast means including a pair of vertically spaced horizontally disposed tubes adjacent the rear of the frame and including a plurality of longitudinally spaced orifices therein for directing air forwardly against the sheet.

* * * * *